US006538647B1

(12) United States Patent
Chen et al.

(10) Patent No.: US 6,538,647 B1
(45) Date of Patent: Mar. 25, 2003

(54) LOW-POWER LCD DATA DRIVER FOR STEPWISELY CHARGING

(75) Inventors: Shang-Li Chen, Hsinchu (TW); Chien-Yu Yi, Taoyuan (TW)

(73) Assignee: Industrial Technology Research Institute (TW)

( * ) Notice: Subject to any disclaimer, the term of this patent is extended or adjusted under 35 U.S.C. 154(b) by 211 days.

(21) Appl. No.: 09/606,576

(22) Filed: Jun. 28, 2000

(51) Int. Cl.[7] ..... G09G 5/00
(52) U.S. Cl. ..... 345/211; 345/98
(58) Field of Search ..... 345/204, 208–215, 345/690–693, 87, 94–96, 98–100

(56) References Cited

U.S. PATENT DOCUMENTS 5,473,526 A * 12/1995 Svensson et al. ..... 363/60
5,748,165 A * 5/1998 Kubota et al. ..... 345/96
5,754,156 A * 5/1998 Erhart et al. ..... 345/98
5,764,225 A * 6/1998 Koshobu ..... 345/211
5,923,312 A * 7/1999 Okada et al. ..... 345/95
6,271,816 B1 * 8/2001 Jeong et al. ..... 345/87
6,351,076 B1 * 2/2002 Yoshida et al. ..... 315/169.1
2002/0015017 A1 * 2/2002 Kwag ..... 345/89
2002/0044115 A1 * 4/2002 Akihito et al. ..... 345/87

* cited by examiner

*Primary Examiner*—Kent Chang
*Assistant Examiner*—Tom V. Sheng
(74) *Attorney, Agent, or Firm*—Blakely Sokoloff Taylor & Zafman

(57) ABSTRACT

A power-saving data driver for stepwisely applying alternating driving voltages with a predetermined number of steps to a plurality of data lines in a liquid crystal display is disclosed. The data driver is comprised of a clocking means, a plurality of reference voltages, and a plurality of analog voltage driver. The clocking means is used for providing clock signals for stepwisely charging and discharging. The plurality of reference voltages work as steps of said stepwisely charging and discharging. The reference voltages are distributed between the system voltage and the ground. Each of the analog voltage driver corresponds to one of the data lines. A given pixel is stepwisely driven from a driving voltage of the last pixel as a beginning voltage to a driving voltage of the given pixel as a target voltage. The reference voltages between the beginning voltage and the target voltage are turned-on in order according to the clock signals generated by the clocking means.

30 Claims, 4 Drawing Sheets

LOW-POWER LCD DATA DRIVER FOR STEPWISELY CHARGING

BACKGROUND OF THE INVENTION (1) Field of the Invention

The present invention relates generally to circuitry for driving an liquid crystal display (LCD) or the like, and more particularly, to a circuit and a method which largely reduce the consumed power for driving the data lines of the LCD display.

(2) Description of the Related Art

The breathtaking growth of the information and communication industries push forward the fast development of LCD displays, which are used in a large variety of products including notebook computers, hand-held computers, cellular phones, and many kinds of personal digital assistants (PDAs). The LCD displays are available in both gray-scale and color panels, and are typically arranged as a matrix of intersecting hundreds or thousands of rows and columns. Generally, the intersection of each row and column forms a pixel, whose brightness and color are defined by the electronic voltage applied thereto.

Figure 1:
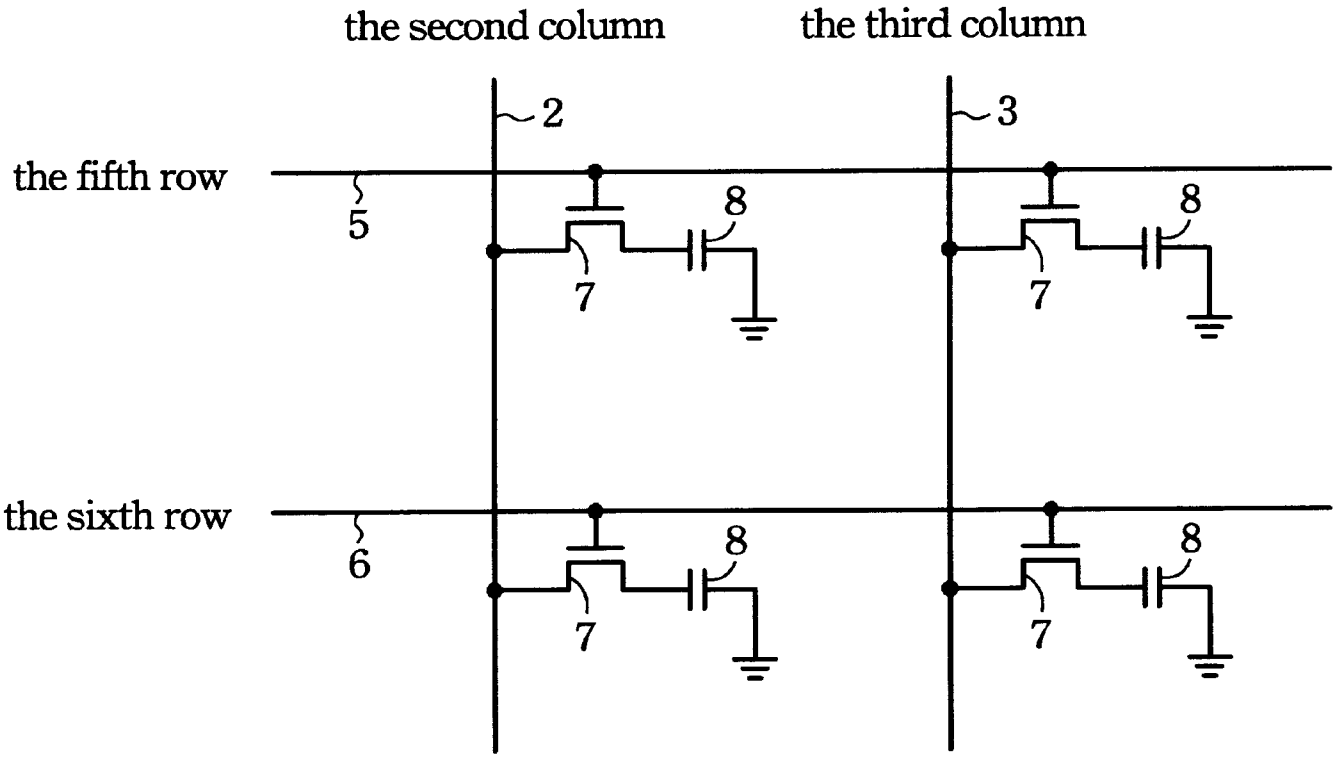
Fig. 1 (Prior Art)

The LCD monitors used in the notebook computers requires a relatively large number of such pixels to form a pixel array. Referring now to FIG. 1, a portion of a pixel array of an active matrix liquid crystal display according to the prior art is shown. The four pixels connected in the fifth row 5, the sixth row 6, the second column 2, and the third column 3 of the array are shown. Each pixel is comprised of a switch 7 and a capacitor 8. The switch of each pixel in the same row is connected by a scan line, and the switch of each pixel in the same column is connected by a data line, The method of controlling the image displayed on the screen is to select one scan line at a time, and to apply control voltages through each data line to each column of the selected scan line. After all columns of the selected scan line are applied the control voltages, the next scan line will be selected to apply control voltages through each data line to its corresponding column. After the completion of one display cycle during which each row in the array has been selected, a new display cycle begins, and the process is repeated to refresh the displayed image.

The data lines are driven by a data driver, which is typically formed upon monolithic integrated circuits. Actually, a color LCD monitor requires three times as many data driver outputs as the monochrome LCD monitor. The color LCD monitor requires three data driver outputs per pixel , one of each of the three primary colors (red, green, blue) to be displayed. Thus, a typical VGA color liquid crystal display with 480 rows×640 columns includes 1920 data lines which must be driven by a like number of column data driver outputs.

The liquid crystal displays are capable of displaying images because the optical transmission characteristics of liquid crystal material change in accordance with the magnitude of the applied electronic voltage. However, the application of a steady DC voltage to a liquid crystal material for a long; period will permanently change and degrade its physical properties. For this reason, it is common to drive the liquid crystal displays using drive techniques which charge each liquid crystal with voltages of alternating polarities relative to a common midpoint voltage value. The voltages greater than and less than the common midpoint voltage represent the positive polarity and the negative polarity, respectively.

Image quality displayed by the LCDs and the complexity of the driver circuitry are highly related to the methods of polarity inversion. There are four major types of inversion of alternating polarities relative to the common midpoint voltage, i.e. frame inversion, column inversion, row inversion, and dot inversion. According to the frame inversion, every pixel on the display frame is first driven to its positive polarity during a first display cycle, and then driven to its negative polarity during the second display cycle. The column inversion implies that each pixel in a data line is driven to the positive polarity, and the adjacent data line is driven to the negative polarity. According to the row inversion, if the pixels in a row are driven to the positive polarity during the first row drive period, the pixels in the next row will be driven to the negative polarity during the second row drive period. According to the dot inversion, if a pixel is charged with the positive polarity, the next pixel within the same row will be charged to the negative polarity, and the adjacent pixel in the same column but in the preceding or following row is also charged to the negative polarity. Although the drive circuitry of the dot inversion is the most complex one, it displays the best image property. For this reason, the dot inversion will be the main stream of the drive circuitry in the field of the liquid crystal displays.

The data driver suffers a relatively large capacity from the data line. In accordance with conventional teachings, power dissipation of a circuit is directly related to the operating frequency (f), the capacitance (C) and the square of the voltage ($V^2$) applied to the capacitive element. For this reason, the power dissipation of a data driver is significant. Especially, in the inversion schemes of the row inversion and the dot inversion, the charging/discharging processes for alternating polarities results in a very large power dissipation.

For this reason, it is very important for LCD industries to develop a low-power LCD data driver.

SUMMARY OF THE INVENTION

Accordingly, it is a primary object of the present invention to provide a low-power LCD data driver.

It is another object of the present invention to provide a method of driving LCD's data lines with low power dissipation.

A power-saving data driver for stepwisely applying alternating driving voltages with a predetermined number of steps to a plurality of data lines in a liquid crystal display is disclosed. The data driver is comprised of a clocking means, a plurality of reference voltages, and a plurality of analog voltage driver. The clocking means is used for providing clock signals for stepwisely charging and discharging. The plurality of reference voltages work as steps.of the stepwisely charging and discharging. The reference voltages are distributed between the system voltage and the ground. Each of the analog voltage driver corresponds to one of the data lines. A given pixel is stepwisely driven from the driving voltage of the last pixel as a beginning voltage to the driving voltage of the given pixel as a target voltage. The reference voltages between the beginning voltage and the target voltage are turned-on in order according to the clock signals generated by the clocking means.

In one embodiment of the present invention, the predetermined number of steps is four and thus there are three reference voltages, i.e. the first reference voltage, the second reference voltage, and the third reference voltage. The second reference voltage is the common midpoint voltage of the alternating driving voltages. The first reference voltage is 75% of the system voltage and the third reference voltage is 25% of the system voltage.

In another embodiment of the present invention, the first reference voltage is a voltage corresponding to the positive polarity with 50% of optical transmission rate, and the third reference voltage is a voltage corresponding to the negative polarity with 50% of optical transmission rate.

In another embodiment of the present invention, the first reference voltage is the positive voltage obtained by charging/discharging a capacitor connected to the analog voltage driver for a plurality of times, and the third reference voltage is a negative voltage obtained by charging/discharging a capacitor connected to the analog voltage driver for a plurality of times.

BRIER DESCRIPTION OF THE DRAWINGS

The accompanying drawings forming a material part of this description, in which

FIG. 1 schematically illustrates a portion of a pixel array of an active matrix liquid crystal display according to the prior art.

Figure 2:
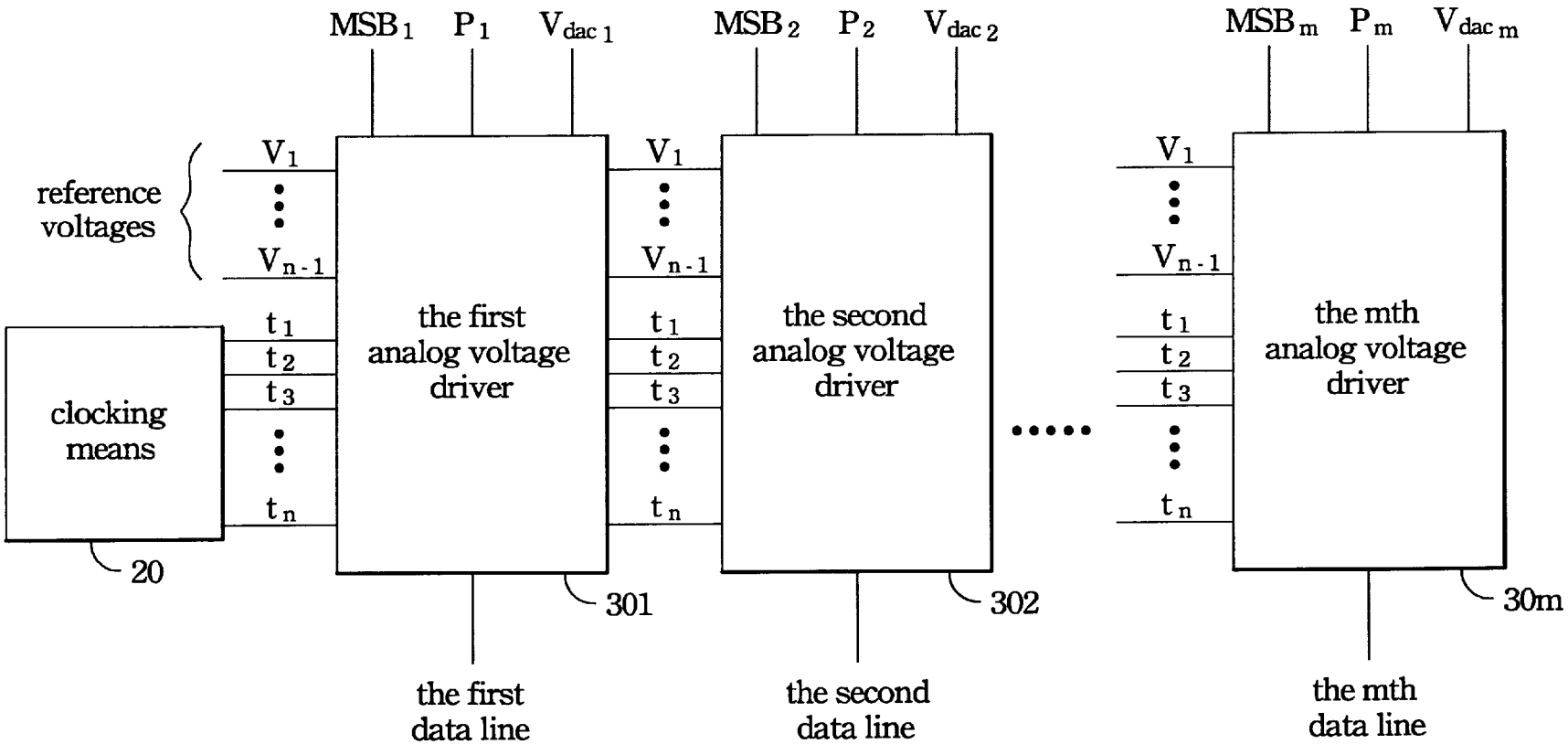

FIG. 2 schematically illustrate the block diagram of the stepwise charge/discharge driver according to the present invention.

Figure 3:
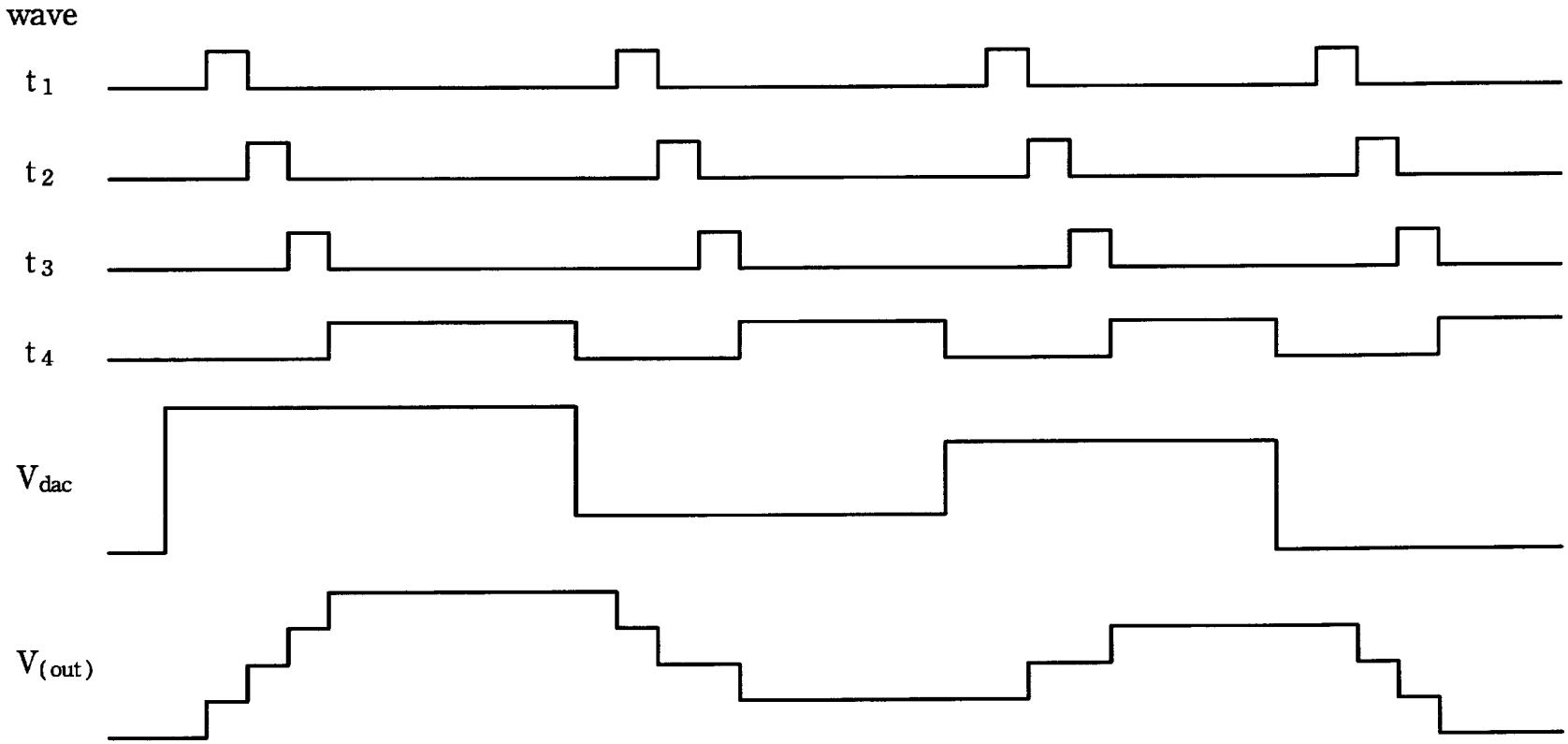

FIG. 3 schematically illustrates the wave diagrams of t1, t2, t3, t4, Vout, and Vdac according to the present invention.

Figure 4:
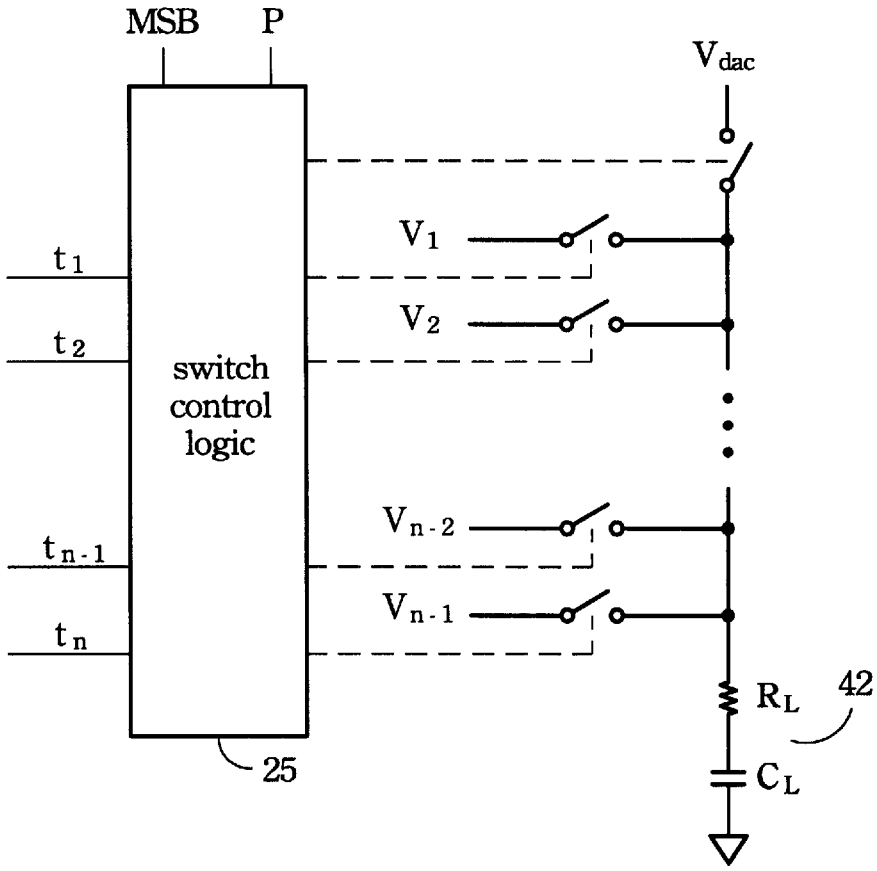

FIG. 4 schematically illustrates the block diagram of the analog voltage driver according to the present invention.

Figure 5:
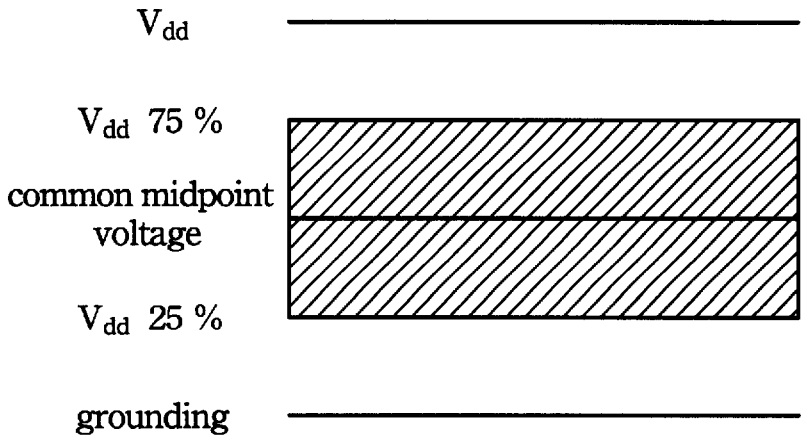

FIG. 5 schematically illustrates the reference voltages according to an embodiment of the present invention.

DESCRIPTION OF THE PREFERRED EMBODIMENTS

The present invention is related to a power-saving data driver for stepwisely applying alternating driving voltages with a predetermined number of steps to a plurality of data lines in a liquid crystal display.

As mentioned above, the liquid crystal display should be driven by alternation polarities relative to the common midpoint voltage value. For this reason, the data line driver should keep charging and discharging the data lines continuously, especially in the case of row inversion and dot inversion. According to the present invention, a plurality of switches in the analog voltage driver are controlled by the polarities (P) and the MSBs of the digital data of the driving voltage so as to largely reduce the power dissipation.

The driving voltage Vdac is derived from the traditional digital-analog-converter for driving the data lines. As mentioned in the background of the invention, the driving voltage Vdac is directly coupled to the data lines according to the prior art. That will result in large power dissipation. In order to reduce the power dissipation, the method of stepwise charge and discharge is applied in the present invention.

The energy dissipated is $1/2(CV^2)$ for each charge/discharge process applied to a capacitive element, where C is the capacitance of the capacitive element and V is the maximum voltage in the charge or discharge process. In case the charge or discharge process is divided into n steps and the voltage variation of each step is V/n, the energy dissipation for each step is $(1/2)(CV^2)/n^2$. As a result, the energy dissipate of n steps is $(1/2)(CV^2)/n$, which is the conventional energy dissipation divided by n. For example, if the predetermined number of steps is four, the energy dissipation will be the conventional energy dissipation divided by four, and thus largely reduced. About this theory, please refer to U.S. Pat. No. 5,473526 for more detailed.

Referring now to FIG. 2, the block diagram of the driver circuitry for stepwisely charging and discharging according to the present invention is disclosed. The driver circuitry is comprised of a clocking means 20, a plurality of reference voltages, and a plurality of analog voltage drivers 30. Each analog voltage driver corresponds to one of the plurality of data lines, wherein the first analog voltage drivers 301, the second analog voltage drivers 302, and the mth analog voltage driver 30 m are shown in FIG. 2.

The clocking means 20 is used for generating clock signals for stepwisely charging and discharging. The input terminal of the clocking means 20 is coupled to system clock CLK and RST, and its output terminal provides clock signals t1, t2, t3. . . , tn for stepwisely charging and discharging to all of the analog voltage drivers including the first analog voltage drivers 301, the second analog voltage drivers 302, and the mth analog voltage driver 30 m, wherein n implies the predetermined number of steps. For example, if the predetermined number of steps is four, the clocking means 20 will provide four clock signals of t1, t2, t3, and t4, as shown in FIG. 3.

The number of the plurality of reference voltages is the predetermined number of steps minus one, and the plurality of reference voltages are distributed between the system voltage (Vdd) and the ground.

The input terminal of the first analog voltage driver 301 is coupled to the clocking means, the plurality of reference voltages V1, . . . , Vn−1, the driving voltage Vdac1, the polarity P, and the brightness information MSB (most significant bit). The output terminal of the first analog voltage driver 301 is coupled to the first data line for driving it. In addition, the other analog voltage drivers such as the second analog voltage driver 302 to the mth analog voltage driver 30m have the same connection relationship. The output terminal of each analog voltage is coupled to its corresponding data line.

Referring now to. FIG. 4, the block diagram of the analog voltage driver according to the present invention is disclosed. The input terminal of the analog voltage driver 30 is coupled to the driving voltage Vdac1 and the plurality of reference voltages V1, . . . , Vn−1 from the switch control logic 25. Its output terminal is coupled to its corresponding data line, i.e. the load 42. The analog voltage driver 30 includes the first switch element and the other n−1 switch elements, which can be MOS transistors. The n switch elements in the analog voltage driver 30 are turned on or off in sequence depending on the polarity P and the brightness information MSB. As a result, the stepwise charge and discharge can be well achieved, as shown in FIG. 3.

The driving method according to the present invention is described as follows. As mentioned above, it is common to drive the liquid crystal displays using drive techniques which charge each liquid crystal with voltages of alternation polarities relative to the common midpoint voltage value, which is 50% of the system voltage Vdd. The positive polarity voltages imply the driving voltages between the system voltage Vdd and the common midpoint voltage, and the negative polarity voltages imply the driving voltages between the common midpoint voltage and the ground. According to the normally black LCD panels, the liquid crystal layer transmits no light if no driving voltage is applied to. The larger the driving voltage, the higher the optical transmission rate is. This implies that a given pixel is brighter when the driving voltage is closer to the system voltage Vdd or the ground. On the other hand, a pixel is darker when the driving voltage is near the common mid-point voltage.

According to the first embodiment of the present invention, the predetermined number of steps is four, which implies that there are four steps for the analog voltage driver 30 to stepwisely charge and discharge. Referring now to FIG. 5, the reference voltages according to the first embodiment of the present invention is disclosed. The midpoint voltage is between the system voltage Vdd and the ground, and called Vdd 50%. The other two reference voltages, i.e. 75% of the system voltage (called Vdd 75%) and 25% of the system voltage (called Vdd 25%), are also shown in FIG. 5. Generally, the brightness of two adjacent pixels are close. For this reason, we suppose that the present pixel and the last pixel have mearly the same brightness and thus have the same MSB and opposite polarities. The four switch elements for turning-on Vdd 25%, Vdd 50%, Vdd 75%, and the driving voltage are turned on depending on the combinations of polarities P and the brightness MSB of the current pixel as follows.

1. Positive polarity (P=1)-bright (MSB=1): turning on Vdd 25%, Vdd 50%, Vdd 75%, and Vdac in order.
2. Negative Polarity (P=0)-bright (MSB=1): turning on Vdd 75%, Vdd 50%, Vdd 25%, and Vdac in order.
3. Positive polarity (P=1)-dark (MSB=0): turning on Vdd 50%, and Vdac in order.
4. Negative Polarity (P=0)-dark (MSB=0): turning on Vdd 50%, and Vdac in order.

In the first case, a bright pixel will be driven by the positive polarity, so the driving voltage output from the digital-analog-converter (Vdac) is located between Vdd and Vdd 75%. In this embodiment, the MSB of the last pixel is supposed to be the same with that of the present pixel but with opposite polarity, so the driving voltage of the last pixel is located between the ground and Vdd 25%. For this reason, the present pixel is stepwisely driven from the driving voltage of the last pixel to Vdd 25%, Vdd 50%, Vdd 75%, and Vdac in order. As mentioned above, the power dissipation of the data line driver can be largely reduced by means of the stepwise charge.

In the second case, a bright pixel will be driven by the negative polarity, so the driving voltage output from the digital-analog-converter (Vdac) is located between the ground and Vdd 25%. In this embodiment, the MSB of the last pixel is supposed to be the same with that of the present pixel but with opposite polarity, so the driving voltage of the last pixel is located between Vdd and Vdd 75%. For this reason, the present pixel is stepwisely driven from the driving voltage of the last pixel to Vdd 75%, Vdd 50%, Vdd 25%, and Vdac in order. As mentioned above, the power dissipation of the data line driver can be largely reduced by means of the stepwise discharge.

In the third case, a dark pixel will be driven by the positive polarity, so the driving voltage output from the digital-analog-converter (Vdac) is located between Vdd 50% and Vdd 75%. In this embodiment, the MSB of the last pixel is supposed to be the same with that of the present pixel but with opposite polarity, so the driving voltage of the last pixel is located between Vdd 50% and Vdd 25%. For this reason, the present pixel is stepwisely driven from the driving voltage of the last pixel to Vdd 50% and Vdac in order. As mentioned above, the power dissipation of the data line driver can be largely reduced by means of the stepwise charge.

In the fourth case, a dark pixel will be driven by the negative polarity, so the driving voltage output from the digital-analog-converter (Vdac) is located between Vdd 50% and Vdd 25%. In this embodiment, the MSB of the last pixel is supposed to be the same with that of the present pixel but with opposite polarity, so the driving voltage of the last pixel is located between Vdd 50% and Vdd 75%. For this reason, the present pixel is stepwisely driven from the driving voltage of the last pixel to Vdd 50% and Vdac in order. As mentioned above, the power dissipation of the data line driver can be largely reduced by means of the stepwise discharge.

According to the first embodiment of the present invention, the MSB of the last pixel is supposed to be the same with that of the present pixel. However, in the actual practice, the MSB of the last pixel can be different to that of the present pixel. In order to take this issue into consideration for further reducing the power dissipation, the circuit of the analog voltage driver is modified according to the second embodiment, so that Vdd 25%, Vdd 50%, Vdd 75%, and Vdac can be turned on depending on the polarity, MSB of the present pixel, and MSB of the last pixel (called Mp). There are total eight cases as follows:

1. P=1, MSB=Mp=1: turning on Vdd 25%, Vdd 50%, Vdd 75%, and Vdac in order.
2. P=0, MSB=Mp=1: turning on Vdd 75%, Vdd 50%, Vdd 25%, and Vdac in order.
3. P=1, MSB=Mp=0: turning on Vdd 50%, and Vdac in order.
4. P=0, MSB=Mp=0: turning on Vdd 50%, and Vdac in order.
5. P=1, MSB=1, Mp=0: turning on Vdd 50%, Vdd 75%, and Vdac in order.
6. P=0, MSB=1, Mp=0: turning on Vdd 50%, Vdd 25%, and Vdac in order.
7. P=1, MSB=0, Mp=1: turning on Vdd 25%, Vdd 50%, and Vdac in order.
8. P=0, MSB=0, Mp=1: turning on Vdd 75%, Vdd 50%, and Vdac in order.

In the first case, a bright pixel will be driven by the positive polarity, so the driving voltage output from the digital-analog-converter (Vdac) is located between Vdd and Vdd 75%. In this case, the MSB of the last pixel is the same with the present pixel but with opposite polarity, so the driving voltage of the last pixel is located between the ground and Vdd 25%. For this reason, the present pixel is stepwisely driven from the driving voltage of the last pixel to Vdd 25%, Vdd 50%, Vdd 75%, and Vdac in order. As mentioned above, the power dissipation of the data line driver can be largely reduced by means of the stepwise charge.

In the second case, a bright pixel will be driven by the negative polarity, so the driving voltage output from the digital-analog-converter (Vdac) is located between the ground and Vdd 25%. In this case, the MSB of the last pixel is the same with the present pixel but with opposite polarity, so the driving voltage of the last pixel is located between Vdd and Vdd 75%. For this reason, the present pixel is stepwisely driven from the driving voltage of the last pixel to Vdd 75%, Vdd 50%, Vdd 25%, and Vdac in order. As mentioned above, the power dissipation of the data line driver can be largely reduced by means of the stepwise discharge.

In the third case, a dark pixel will be driven by the positive polarity, so the driving voltage output from the digital-analog-converter (Vdac) is located between Vdd 50% and Vdd 75%. In this case, the MSB of the last pixel is the same with the present pixel but with opposite polarity, so the driving voltage of the last pixel is located between Vdd 50% and Vdd 25%. For this reason, the present pixel is stepwisely driven from the driving voltage of the last pixel to Vdd 50% and Vdac in order. As mentioned above, the power dissipation of the data line driver can be largely reduced by means of the stepwise charge.

In the fourth case, a dark pixel will be driven by the negative polarity, so the driving voltage output from the digital-analog-converter (Vdac) is located between Vdd 50% and Vdd 25%. In this case, the MSB of the last pixel is the same with the present pixel but with opposite polarity, so the driving voltage of the last pixel is located between Vdd 50% and Vdd 75%. For this reason, the present pixel is stepwisely driven from the driving voltage of the last pixel to Vdd 50% and Vdac in order. As mentioned above, the power dissipation of the data line driver can be largely reduced by means of the stepwise discharge.

In the fifth case, a bright pixel will be driven by the positive polarity, so the driving voltage output from the digital-analog-converter (Vdac) is located between Vdd and Vdd 75%. In this case, the last pixel is a dark one with opposite polarity, so the driving voltage of the last pixel is located between the Vdd 50% and Vdd 25%. For this reason, the present pixel is stepwisely driven from the driving voltage of the last pixel to Vdd 50%, Vdd 75%, and Vdac in order. As mentioned above, the power dissipation of the data line driver can be largely reduced by means of the stepwise charge.

In the sixth case, a bright pixel will be driven by the negative polarity, so the driving voltage output from the digital-analog-converter (Vdac) is located between the ground and Vdd 25%. In this case, the last pixel is a dark one with opposite polarity, so the driving voltage of the last pixel is located between the Vdd 50% and Vdd 75%. For this reason, the present pixel is stepwisely driven from the driving voltage of the last pixel to Vdd 50%, Vdd 25%, and Vdac in order. As mentioned above, the power dissipation of the data line driver can be largely reduced by means of the stepwise discharge.

In the seventh case, a dark pixel will be driven by the positive polarity, so the driving voltage output from the digital-analog-converter (Vdac) is located between Vdd 50% and Vdd 75%. In this case, the last pixel is a bright one with opposite polarity, so the driving voltage of the last pixel is located between the ground and Vdd 25%. For this reason, the present pixel is stepwisely driven from the driving voltage of the last pixel to Vdd 25%, Vdd 50%, and Vdac in order. As mentioned above, the power dissipation of the data line driver can be largely reduced by means of the stepwise charge.

In the eighth case, a dark pixel will be driven by the negative polarity, so the driving voltage output from the digital-analog-converter (Vdac) is located between Vdd 50% and Vdd 25%. In this case, the last pixel is a bright one with opposite polarity, so the driving voltage of the last pixel is located between Vdd and Vdd 75%. For this reason, the present pixel is stepwisely driven from the driving voltage of the last pixel to Vdd 75%, Vdd 50%, and Vdac in order. As mentioned above, the power dissipation of the data line driver can be largely reduced by means of the stepwise discharge.

In the second embodiment, it is taken into consideration that the gray-scale of the present pixel is different to that of the last pixel. According to the charge/discharge method of the present invention, the MSB difference of the adjacent two pixel will no more result in extra charge or discharge process. As a result, the power dissipation according to this embodiment can be further reduced.

According to the foregoing two embodiment, it is assumed that the liquid crystal has a linear photo-electonic relationship, so as to set the reference voltages as Vdd 75%, Vdd 50%, and Vdd 25%.

Actually, the photo-electronic relationship is not necessary to be linear. In accordance with another embodiment of the present invention, the non-linear photo-electronic relationship is taken into consideration. Besides the common midpoint voltage, two more reference voltages are applied. One of them is a voltage corresponding to the positive polarity with 50% of optical transmission rate, and the other one is a voltage corresponding to the negative polarity with 50% of optical transmission rate.

In accordance with another embodiment of the present invention, besides the common midpoint voltage, two more reference voltages are applied. One of them is a positive voltage obtained by charging/discharging a capacitor connected to the analog voltage driver for a plurality of times, and the other one is a negative voltage obtained by charging/discharging a capacitor connected to the analog voltage driver for a plurality of times.

Of course, the predetermined number of steps is not necessary to be four. According to another embodiment of the present invention, the predetermined number of steps is two. The common midpoint voltage of the alternating driving voltages is defined as the reference voltage, wherein the first region is defined by voltages between the system voltage and the reference voltage and driven by the positive polarity, and the second region is defined by voltages between the reference voltage and the ground, and driven by the negative polarity.

According to another embodiment of the present invention, the predetermined number of steps is eight, and thus the number of the plurality of reference voltages is seven, including the first reference voltage, the second reference voltage, the third reference voltage, the fourth reference voltage, the fifth reference voltage, the sixth reference, and the seventh reference voltage. The fourth reference voltage is a common midpoint voltage of the alternating driving voltages. The first region is defined by voltages between the system voltage and the first reference voltage, and driven by the positive polarity. The second region is defined by voltages between the first reference voltage and the second reference voltage, and driven by the positive polarity. The third region is defined by voltages between the second reference voltage and the third reference voltage, and driven by the positive polarity. The fourth region is defined by voltages between the third reference voltage and the fourth reference voltage, and driven by the positive polarity. The fifth region is defined by voltages between the fourth reference voltage and the fifth reference voltage, and driven by the negative polarity. The sixth region is defined by voltages between the fifth reference voltage and the sixth reference voltage, and driven by the negative polarity. The seventh region is defined by voltages between the sixth reference voltage and the seventh reference voltage, and driven by the negative polarity. The eighth region is defined by voltages between the seventh reference voltage and the ground, and driven by the negative polarity.

According to another embodiment of the present invention, the predetermined number of steps can be sixteen or more larger. However, the predetermined number of steps cannot increase without limit. Otherwise, too many charging/discharging steps would not only lengthen the charge/discharge duration, but also increase the complexity of the driving circuitry so as to enhance the power dissipation.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What we claimed is:

1. A power-saving data driver by stepwise applying alternating driving voltages to a plurality of data lines of a liquid crystal display, said data driver comprising:

a clocking means for providing clock signals;

a plurality of reference voltages as steps of stepwise charging and discharging, wherein the number of said plurality of reference voltages equals to a predetermined number minus one;

said plurality of reference voltages are distributed between a system voltage and a ground; and a plurality of analog voltage drivers, wherein each of said plurality of analog voltage driver corresponds to one of said plurality of data lines;

input terminal of each said plurality of analog voltage driver is coupled to said clocking means, said plurality of reference voltages, an analog driving voltage, and information of driving polarity and brightness;

output terminal of each said plurality of analog voltage driver is coupled to its corresponding data line which is connected to a plurality of pixels; wherein a given pixel is driven by a polarity opposite to the polarity for driving last pixel;

said given pixel is driven from a driving voltage of said last pixel as a beginning voltage stepwisely and sequentially through said reference voltages to a driving voltage of said given pixel according to said clock signals generated by said clocking means.

2. The power-saving data driver of claim 1, wherein said predetermined number of steps is four and thus said number of said plurality of reference voltages is three, wherein:

said three reference voltages includes a first reference voltage, a second reference voltage, and a third reference;

said second reference voltage is a common midpoint voltage of said alternating driving voltages;

a first region is defined by voltages between said system voltage and said first reference voltage, and driven by a positive polarity;

a second region is defined by voltages between said first reference voltage and said second reference voltage, and driven by a positive polarity;

a third region is defined by voltages between said second reference voltage and said third reference voltage, and driven by a negative polarity;

a fourth region is defined by voltages between said third reference voltage and said ground, and driven by a negative polarity.

3. The power-saving data driver of claim 2, wherein said first reference voltage is 75% of said system voltage and said third reference voltage is 25% of said system voltage.

4. The power-saving data driver of claim 2, wherein said first reference voltage is a voltage corresponding to positive polarity with 50% of optical transmission rate, and said third reference voltage is a voltage corresponding to negative polarity with 50% of optical transmission rate.

5. The power-saving data driver of claim 2, wherein said first reference voltage is a positive voltage obtained by charging/discharging a capacitor connected to said analog voltage driver a plurality of times; said second reference voltage is obtained by charging/discharging a capacitor connected to said analog voltage driver a plurality of times; and said third reference voltage is a negative voltage obtained by charging/discharging a capacitor connected to said analog voltage driver a plurality of times.

6. The power-saving data driver of claim 2, wherein said given pixel is stepwisely driven from said driving voltage of said last pixel to said third reference voltage, to said second reference voltage, to said first reference voltage, and finally to said driving voltage of said give pixel when said driving voltage of said given pixel is located in said first region and said driving voltage of said last pixel is located in said fourth region.

7. The power-saving data driver of claim 2, wherein said given pixel is stepwisely driven from said driving voltage of said last pixel to said first reference voltage, to said second reference voltage, to said third reference voltage, and finally to said driving voltage of said give pixel when said driving voltage of said given pixel is located in said fourth region and said driving voltage of said last pixel is located in said first region.

8. The power-saving data driver of claim 2, wherein said given pixel is stepwisely driven from said driving voltage of said last pixel to said second reference voltage and finally to said driving voltage of said give pixel when said driving voltage of said given pixel is located in said second region and said driving voltage of said last pixel is located in said third region.

9. The power-saving data driver of claim 2, wherein said given pixel is stepwisely driven from said driving voltage of said last pixel to said second reference voltage and finally to said driving voltage of said give pixel when said driving voltage of said given pixel is located in said third region and said driving voltage of said last pixel is located in said second region.

10. The power-saving data driver of claim 2, wherein said given pixel is stepwisely driven from said driving voltage of said last pixel to said second reference voltage, to said first reference voltage, and finally to said driving voltage of said give pixel when said driving voltage of said given pixel is located in said first region and said driving voltage of said last pixel is located in said third region.

11. The power-saving data driver of claim 2, wherein said given pixel is stepwisely driven from said driving voltage of said last pixel to said second reference voltage, to said third reference voltage, and finally to said driving voltage of said give pixel when said driving voltage of said given pixel is located in said fourth region and said driving voltage of said last pixel is located in said second region.

12. The power-saving data driver of claim 2, wherein said given pixel is stepwisely driven from said driving voltage of said last pixel to said third reference voltage, to said second reference voltage, and finally to said driving voltage of said give pixel when said driving voltage of said given pixel is located in said second region and said driving voltage of said last pixel is located in said fourth region.

13. The power-saving data driver of claim 2, wherein said given pixel is stepwisely driven from said driving voltage of said last pixel to said first reference voltage, to said second reference voltage, and finally to said driving voltage of said give pixel when said driving voltage of said given pixel is located in said third region and said driving voltage of said last pixel is located in said first region.

14. The power-saving data driver of claim 1, wherein said predetermined number of steps is two and a common midpoint voltage of said alternating driving voltages is defined as a reference voltages, wherein a first region is defined by voltages between said system voltage and said reference voltage and driven by positive polarity, and a second region is defined by voltages between said reference voltage and said ground, and driven by negative polarity.

15. The power-saving data driver of claim 1, wherein said predetermined number of steps is eight, and thus said number of said plurality of reference voltages is seven, wherein:

said seven reference voltages includes a first reference voltage, a second reference voltage, a third reference voltage, a fourth reference voltage, a fifth reference voltage, a sixth reference, and a seventh reference voltage;

said fourth reference voltage is a common midpoint voltage of said alternating driving voltages;

a first region is defined by voltages between said system voltage and said first reference voltage, and driven by a positive polarity;

a second region is defined by voltages between said first reference voltage, and said second reference voltage, and driven by a positive polarity;

a third region is defined by voltages between said second reference voltage and said third reference voltage, and driven by a positive polarity;

a fourth region is defined by voltages between said third reference voltage and said fourth reference voltage, and driven by a positive polarity;

a fifth region is defined by voltages between said fourth reference voltage and said fifth reference voltage, and driven by a negative polarity;

a sixth region is defined by voltages between said fifth reference voltage and said sixth reference voltage, and driven by a negative polarity;

a seventh region is defined by voltages between said sixth reference voltage and said seventh reference voltage, and driven by a negative polarity;

a eighth region is defined by voltages between said seventh reference voltage and said ground, and driven by a negative polarity.

16. A power-saving data driving method for stepwisely applying alternating driving voltages with a predetermined number of steps to a plurality of data lines in a liquid crystal display, said driving method comprising:

providing clock signals for stepwisely charging and discharging by a clocking means;

providing a plurality of reference voltages distributed between a system voltage and a ground as steps of said stepwisely charging and discharging; and providing a plurality of analog voltage driver, wherein each said plurality of analog voltage driver corresponds to one of said plurality of data lines;

stepwisely driving a given pixel from a driving voltage of a last pixel as a beginning voltage to a driving voltage of said given pixel as a target voltage, wherein said reference voltages between said beginning voltage and said target voltage are turned-on in order according to said clock signals generated by said clocking means.

17. The power-saving data driving method of claim 16, wherein said predetermined number of steps is four and there are three reference voltages, wherein:

said three reference voltages includes a first reference voltage, a second reference voltage, and a third reference;

said second reference voltage is a common midpoint voltage of said alternating driving voltages;

a first region is defined by voltages between said system voltage and said first reference voltage, and driven by a positive polarity;

a second region is defined by voltages between said first reference voltage and said second reference voltage, and driven by a positive polarity;

a third region is defined by voltages between said second reference voltage and said third reference voltage, and driven by a negative polarity;

a fourth region is defined by voltages between said third reference voltage and said ground, and driven by a negative polarity.

18. The power-saving data driving method of claim 17, wherein said first reference voltage is 75% of said system voltage and said third reference voltage is 25% of said system voltage.

19. The power-saving data driving method of claim 17, wherein said first reference voltage is a voltage corresponding to positive polarity with 50% of optical transmission rate, and said third reference voltage is a voltage corresponding to negative polarity with 50% of optical transmission rate.

20. The power-saving data driving method of claim 17, wherein said first reference voltage is a positive voltage obtained by charging/discharging a capacitor connected to said analog voltage driver a plurality of times; said second reference voltage is obtained by charging/discharging a capacitor connected to said analog voltage driver a plurality of times; and said third reference voltage is a negative voltage obtained by charging/discharging a capacitor connected to said analog voltage driver a plurality of times.

21. The power-saving data driving method of claim 17, wherein said given pixel is stepwisely driven from said driving voltage of said last pixel to said third reference voltage, to said second reference voltage, to said first reference voltage, and finally to said driving voltage of said give pixel when said driving voltage of said given pixel is located in said first region and said driving voltage of said last pixel is located in said fourth region.

22. The power-saving data driving method of claim 17, wherein said given pixel is stepwisely driven from said driving voltage of said last pixel to said first reference voltage, to said second reference voltage, to said third reference voltage, and finally to said driving voltage of said give pixel when said driving voltage of said given pixel is located in said fourth region and said driving voltage of said last pixel is located in said first region.

23. The power-saving data driving method of claim 17, wherein said given pixel is stepwisely driven from said driving voltage of said last pixel to said second reference voltage and finally to said driving voltage of said give pixel when said driving voltage of said given pixel is located in said second region and said driving voltage of said last pixel is located in said third region.

24. The power-saving data driving method of claim 17, wherein said given pixel is stepwisely driven from said driving voltage of said last pixel to said second reference voltage and finally to said driving voltage of said give pixel when said driving voltage of said given pixel is located in said third region and said driving voltage of said last pixel is located in said second region.

25. The power-saving data driving method of claim 17, wherein said given pixel is stepwisely driven from said driving voltage of said last pixel to said second reference voltage, to said first reference voltage, and finally to said driving voltage of said give pixel when said driving voltage of said given pixel is located in said first region and said driving voltage of said last pixel is located in said third region.

26. The power-saving data driving method of claim 17, wherein said given pixel is stepwisely driven from said driving voltage of said last pixel to said second reference voltage, to said third reference voltage, and finally to said driving voltage of said give pixel when said driving voltage of said given pixel is located in said fourth region and said driving voltage of said last pixel is located in said second region.

27. The power-saving data driving method of claim 17, wherein said given pixel is stepwisely driven from said driving voltage of said last pixel to said third reference voltage, to said second reference voltage, and finally to said driving voltage of said give pixel when said driving voltage of said given pixel is located in said second region and said driving voltage of said last pixel is located in said fourth region.

28. The power-saving data driving method of claim 17, wherein said given pixel is stepwisely driven from said driving voltage of said last pixel to said first reference voltage, to said second reference voltage, and finally to said driving voltage of said give pixel when said driving voltage of said given pixel is located in said third region and said driving voltage of said last pixel is located in said first region.

29. The power-saving data driving method of claim 16, wherein said predetermined number of steps is two and a common midpoint voltage of said alternating driving voltages is defined as a reference voltages, wherein a first region is defined by voltages between said system voltage and said reference voltage and driven by positive polarity, and a second region is defined by voltages between said reference voltage and said ground, and driven by negative polarity.

30. The power-saving data driving method of claim 16, wherein said predetermined number of steps is eight, and there are seven reference voltages, wherein:

said seven reference voltages includes a first reference voltage, a second reference voltage, a third reference voltage, a fourth reference voltage, a fifth reference voltage, a sixth reference, and a seventh reference voltage;

said fourth reference voltage is a common midpoint voltage of said alternating driving voltages;

a first region is defined by voltages between said system voltage and said first reference voltage, and driven by a positive polarity;

a second region is defined by voltages between said first reference voltage and said second reference voltage, and driven by a positive polarity;

a third region is defined by voltages between said second reference voltage and said third reference voltage, and driven by a positive polarity;

a fourth region is defined by voltages between said third reference voltage and said fourth reference voltage, and driven by a positive polarity;

a fifth region is defined by voltages between said fourth reference voltage and said fifth reference voltage, and driven by a negative polarity;

a sixth region is defined by voltages between said fifth reference voltage and said sixth reference voltage, and driven by a negative polarity;

a seventh region is defined by voltages between said sixth reference voltage and said seventh reference voltage, and driven by a negative polarity;

a eighth region is defined by voltages between said seventh reference voltage and said ground, and driven by a negative polarity.

* * * * *